US005506012A

United States Patent [19]

Wright et al.

[11] Patent Number: 5,506,012

[45] Date of Patent: Apr. 9, 1996

[54] MULTIPLE CHAMBERED LIFT BAG

[75] Inventors: Hancel R. Wright, Rockmart, Ga.; Harry T. Metcalfe, North Wales, Pa.

[73] Assignee: Engineered Fabrics Corp., Rockmart, Ga.

[21] Appl. No.: 221,482

[22] Filed: Apr. 1, 1994

[51] Int. Cl.[6] ..... B66F 3/24

[52] U.S. Cl. ..... 428/35.2; 428/35.5; 428/36.1; 428/36.8; 428/72; 428/141; 428/167; 428/180; 428/192; 428/200; 383/3; 254/93 HP; 92/90; 92/91; 92/92; 5/615; 5/932

[58] Field of Search ..... 428/68, 69, 493, 428/36.8, 35.2, 35.4, 35.5, 192, 200, 76, 72, 156, 167, 141, 180, 36.1, 36.2; 5/615, 932, 81.1; 254/93 HP; 92/90, 91, 92; 383/3

[56] References Cited

U.S. PATENT DOCUMENTS

| | | | |
|---|---|---|---|
| 3,744,756 | 7/1973 | Smith | 254/93 HP |
| 4,016,315 | 4/1977 | Szabo | 428/68 |
| 4,275,869 | 6/1981 | Clements | 254/93 HP |
| 4,688,760 | 8/1987 | Garman et al. | 254/93 HP |
| 4,804,565 | 2/1989 | Rast | 428/69 |
| 5,082,712 | 1/1992 | Starp | 428/180 |
| 5,234,740 | 8/1993 | Reeves et al. | 428/141 |

*Primary Examiner*—Ellis P. Robinson
*Assistant Examiner*—Rena L. Dye
*Attorney, Agent, or Firm*—Renner, Kenner, Greive, Bobak Taylor & Weber

[57] ABSTRACT

A lift bag includes a plurality of independently inflatable chambers for controlling lifting of objects. Each chamber is defined by an upper surface sheet and a lower surface sheet, the upper surface sheet of one chamber positioned below an adjacent chamber being securely attached to the lower surface sheet of an adjacent chamber. The lift bag can be operated at pressures of about 15 psig at specified heights which allows greater flexibility compared to conventional, single-chambered lift bag which operate at pressures of about 7 psig. Preferably, all seams, reinforcements, and fittings are vulcanized in place using uncured rubber coated fabric. Grommets or other securing means may provide further stability to the lift bag.

9 Claims, 3 Drawing Sheets

MULTIPLE CHAMBERED LIFT BAG

TECHNICAL FIELD

The invention herein resides in the art of lift bags. More particularly, the invention relates to lift bags having a plurality of individual chambers which may be inflated independently for controlled lifting purposes. Specifically, the multiple chambered lift bags of the present invention are designed to operate at low to medium pressures of up to about 15 pounds per square inch (psig), thereby providing improved lifting capacity and performance to the bag as compared to conventional low pressure lift bags which permit operating pressures of only about 7 psig.

BACKGROUND OF THE INVENTION

Low pressure lift bags have long been used for emergency rescue operations where heavy objects are required to be lifted. For the purposes of this application, it will be understood that the term "heavy" is used qualitatively to identify objects such as vehicles and the like which cannot be lifted easily by hand, rather than quantitatively. Typically, these lift bags are initially maintained in a relatively flat state so that they may be readily positioned under the object to be lifted. Once the flat lift bag is placed beneath the object to be lifted, air pressure may be dispensed from an air hose or the like to the lift bag through an inflation tube extending from the bag, thereby inflating the bag to heights of typically about 24 inches to 48 inches. Because of their relatively low air pressure (previously about 7 to 7.5 psig) and their relatively large surface area, many low pressure lift bags are seen as being effective for lifting heavy objects to significantly large heights relatively easily and safely. In contrast, high pressure bags, i.e., those suited to operate at about 118 psig or more, are known to lift heavier loads than the low pressure bags, but typically are only capable of lifting loads to significantly shorter heights.

Nevertheless, these single-chambered, low pressure lift bags are not suitable for all lifting purposes. For instance, when the bag is being inflated, air will go to the area of least resistance before it begins to lift the heavy object. In many cases, this will cause the bag to roll or twist under the load, and may even cause the load itself to shift. Consequently, when this happens, the operator has to stop the lift, deflate the bag, and reposition the bag before inflating it again. Furthermore, because the air in the bag will go to the area of least resistance, the bag will first inflate outwardly with its side walls ballooning before the bag will do any lifting. Again, this could cause the load being lifted to shift and may cause the bag to work like a spreader rather than a jack. Because the side walls of the bag must become fully inflated prior to lifting the load, the victim must be watched and protected from being pushed or crowded by the bag as it is inflated.

Another major problem with low pressure lift bags is the inconvenience associated with deflating the bags. Because most low pressure bags have side walls, they must be constantly manipulated by pushing and folding the sides inward in order to have the bag situated for its next use. In fact, it is essentially impossible to get the bag to deflate to its original position without the user struggling to fold the side walls inward.

Yet another problem pertains to the fabrication of the bags. Currently, there are at least two types of low pressure lift bags available to the emergency rescue industry. Both of these types of bags are single chambered bags constructed of a fabric such as nylon, canvas or other synthetic fibrous fabric such Kevlar™ coated with rubber such as neoprene. To make the conventional lift bags, the coated fabrics are cut into various sizes to form a pattern and cold glued to secure the side walls and various other parts of the bag together. To make certain areas of the bag stronger and stiffer, the manufacturer typically glues more than one layer of fabric together to form certain parts of the bag such as the top surface and bottom surface. This method of fabrication, known as the "cut and paste" operation, is generally well known in the art.

However, a major problem with this technology is that the glue has been shown to crystallize and fail after about 10 to 12 years of use, even when stored in controlled storage environments. Consequently, the life of the fabric (providing it is not torn or ruptured) far outlasts the life of the glue. Moreover, the use of glue limits the amount of air pressure used in the bags. Typically, bags using current glue technology achieve burst pressures of only about 15 to 20 psig. That is, while most of these air bags are only operatively filled to a pressure of only about 7 to 7.5 psig, the burst pressures (not operating pressures) of these bags have been found to be typically about 1.5 times the operating pressure, although a few of these bags have been known to have slightly higher burst pressures of up to about 2.5 times the operating pressure, i.e., about 15 to 20 psig, when unrestrained by an object to be lifted. It has been found that operating these low pressure lift bags at higher inflation pressures may rupture the bag during lifting or will not permit the lifting of the heavy object to be adequately controlled and stabilized.

In addition, even though the strength and toughness of the fabric used in these bags have improved over the years, only certain gauges of fabric are suitable for this type of "cut and paste" operation used to fabricate the bags. According, it is still possible to puncture and cut the thin fabric. Moreover, the rubber coating on the fabric has been known to peel off due simply to abrasion and normal wear.

With respect to the two types of lift bags currently available, one type comprises a single chamber and generally includes upper and lower surfaces and expandable side walls folded within the deflated bag. As noted hereinabove, when inflated, this type of lift bag typically expands outwardly and vertically, such that the side walls unfold and expand between the upper and lower surfaces. The resultant inflated lift bag expands to the point where it appears to be a bulging box, relatively cubical in shape. The shape of the bag is generally dictated by the number of layers of fabric used to form the top and bottom surfaces. The stiffness of these areas allows the bag to hold its shape as well as offers protection from the item being lifted and the ground. Of course, when restrained between a flat object parallel to the floor and the floor itself, an area on the top surface of the bag contacting the object to be lifted and an area on the bottom surface of the bag communicating with the floor or like surface will lie generally flat against the object and floor, rather than bulge as noted when inflated and unrestrained.

This type of bag may also be employed as a medium pressure air bag, i.e., it may have an air pressure of about 14.7 psig, provided the rubber-coated fabric and glue are sufficient. However, these lift bags are not adjustable so that they cannot be used at low pressures as well. In other words, these bags are to be used at either low pressure (about 7–7.5 psig) or medium pressure (about 14–15 psig).

The second type of low pressure lift bag known in the art is similar to the above-described lift bag except that it is cylindrical in shape. Notably, it also has only one inflation chamber and includes upper and lower surfaces and side walls which are folded to flatten the bag when in the uninflated condition. Again, as noted hereinabove, upon inflation, the top of the bag expands vertically only after the side walls unfold and expand upwardly and outwardly, such that the bag forms a generally bulging cylinder or other shape depending on the design of the top and bottom surfaces. Furthermore, as noted hereinabove, an area on the top surface of the bag contacting a flat object to be lifted and an area on the bottom surface of the bag communicating with the floor or similar stationary surface will lie generally flat against the object and the floor when in proper use.

However, one major problem which this type of bag is its ability to "kick" out from under the load while the load is being lifted but before the bag is fully inflated. This typically happens when performing lifts which must be lifted to a relatively high height, usually about 36 inches or so and when the bag is not properly positioned under the load. This occurs because, when the bag is not positioned directly under the load, the load travels along an arcuate path as it is being lifted from the ground to a considerable height. Because the top and bottom surfaces generally try to stay flat to the ground, the side walls bend to accommodate the arcuate path, thereby causing the bag to twist and "kick" out from under the load. Moreover, this bag is very susceptible to falling over or rolling over while being inflated.

To stabilize the bag somewhat, some manufacturers use internal straps to try to keep the top and bottom surfaces of the bag parallel to each other. However, as detailed hereinabove, if the top and bottom are not properly aligned, the bag will "walk" or roll over onto its side where there is less protection from possible ruptures due to the thinness of the bag at its side walls. Even with the internal straps, there is no guarantee that the bag will not roll over.

In addition, the conventional lift bags may include an upper gripping surface which is typically glued to the top of the bag. However, this gripping surface does not provide an effective means to keep the heavy object being lifted by the bag from sliding or otherwise moving during the lifting process inasmuch as it is not provided with a suitably rough or friction-providing gripping pad having that specific capability.

Furthermore, the air inlets on these types of bags are not repairable. Consequently, should the inlet be cut, pulled off or otherwise damaged in any way, the bag, in most cases, will be unusable. For these conventional lift bags the air inlet is simply a rubber tube made from the same rubber-coated fabric as the rest of the bag. The tube is usually glued inside the bag and may include a sleeve glued over the outside area of the tube. The inlet tube generally extends from the bag about 4 to 6 inches. Typically, a metal claw fitting or coupling is clamped or crimped to the end of the rubber tube. Notably, however, the weight of the metal fitting may cause the end of the tube to sag, thereby causing the tube to flex. After several years, it has been found that this flexing and wearing of the tube begins to cause the rubber coating to wear off, thereby causing the tube to leak.

Still further, the conventional lift bags do not provide a relief valve to allow any overabundance of air to escape. Thus, any overinflating of the lift bags may cause them to rupture.

Finally, these conventional lift bags have tethering straps which are simply glued to tethering points on the lift bags. There is no reinforcement at these tethering points and thus, if the load were to shift during lifting with the tethering straps already tied as appropriate, the straps could pull out of the bag, thereby possibly damaging the bag.

Therefore, the need exists for a lift bag having multiple inflation chambers to provide improved stability and greater flexibility over existing single-chambered lift bags. The need also exists for a lift bag which can be operated at pressures up to about 15 psig for specified heights and which include inflation and relief valves for each of the chambers of the lift bag.

DISCLOSURE OF INVENTION

In light of the foregoing, it is a first aspect of the present invention to provide a multiple chambered lift bag.

Another aspect of the present invention is to provide a lift bag, as above, which operates both as a low pressure lift bag (operating pressure of about 7–7.5 psig) and as a medium pressure lift bag (operating pressure of about 14–15 psig).

Still another aspect of the present invention is to provide a lift bag, as above, which does not include pieces of coated fabric as side walls and which does not have pieces of fabric cold glued together.

Yet another aspect of the present invention is to provide a lift bag, as above, having a suitable upper gripping pad which is not glued to the top of the bag and which effectively grips the object being lifted and aids the stability of the lift bag and load while lifting.

A further aspect of the present invention is to provide a lift bag, as above, having built-in inflation and relief valves for each air chamber, the valves being repairable if necessary.

Still a further aspect of the present invention is to provide a lift bag, as above, which will not "kick" out from under the load being lifted.

Yet a further aspect is to provide a method for lifting a heavy object using the multiple chambered lift bag of the present invention.

The foregoing and other aspects of the invention, which will become apparent as the detailed description proceeds, are achieved by a lift bag comprising a plurality of independently inflatable chambers. Each chamber is defined by an upper surface sheet and a lower surface sheet. Notably, the upper surface sheet of one chamber positioned below an adjacent chamber is securely attached to the lower surface sheet of the adjacent chamber.

Other aspects of the invention which will become apparent from the description herein are attained by a method for lifting heavy objects comprising the steps of placing a lift bag having multiple independent chambers in a position for effectively lifting the object and independently inflating each of the chambers.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
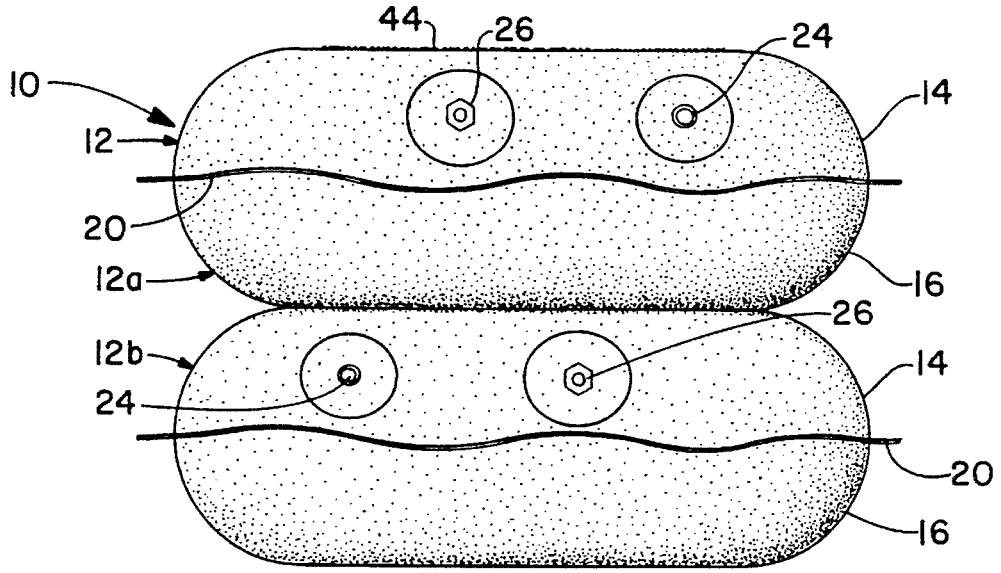
FIG. 1 is a side elevational view of a restrained, inflated lift bag of the present invention.

A lift bag embodying the concepts of the present invention is generally designated by the numeral 10 in FIG. 1 and is shown in its restrained, pillows-like, inflated condition. By "restrained", it is meant that the lift bag 10 is shown as if positioned between the object to be lifted (not shown) and the floor or like surface (not shown). The lift bag 10 is unique in that it includes at least two individual chambers, such as 12*a* and 12*b* in FIG. 1, which independently receive inflation air. Notably, the plurality of chambers 12 provides improved lifting stability and greater flexibility as compared to conventional lift bags having only a single chamber.

Each chamber 12 of lift bag 10 is generally defined by a first sheet 14 of material which provides the upper surface portion of the chamber 12 and a second sheet 16 of material which provides the lower surface portion of the chamber 12. For purposes of clarity, the first sheet 14 and second sheet 16 will be referred to hereinafter as the upper surface sheet and the lower surface sheet, respectively. These sheets may be made from any material known in the art suitable for the purposes described herein, and are preferably made from calendar coated fabric such as nylon. This is somewhat different from the rubber-coated fabrics of the prior art. Unlike the prior art, these sheets have uncured rubber such as neoprene, nitrile rubber, vinyl rubber, polyurethanes, and the like, applied to the fabric under pressure so that the fabric becomes impregnated with the rubber rather than coated. Thus, it is possible to see the woven pattern of the fabric rather than the smooth coated surface like the sheets of the prior art. Calendar coating the fabric prevents the rubber coating from peeling off or cracking during use and adds greatly to the life of the bag. Moreover, the uncured rubberized fabric permits the sheets to be vulcanized together to form the bag without using glue. This creates a stronger, more durable bag. The method for fabricating a bag of this type is detailed hereinbelow.

The sheets may also be of any shape or configuration suitable for use in the present invention, and are shown in the preferred embodiment as being rectangular or, more particularly, square. As can be seen in FIG. 1, the upper surface sheet 14 and its complementary lower surface sheet 16 are sealingly connected at their peripheral edges so that, when inflated, they form the chamber 12. Thus, it will be understood that the lift bag 10 is devoid of any additional sheets of material which might represent side walls.

Figure 2:
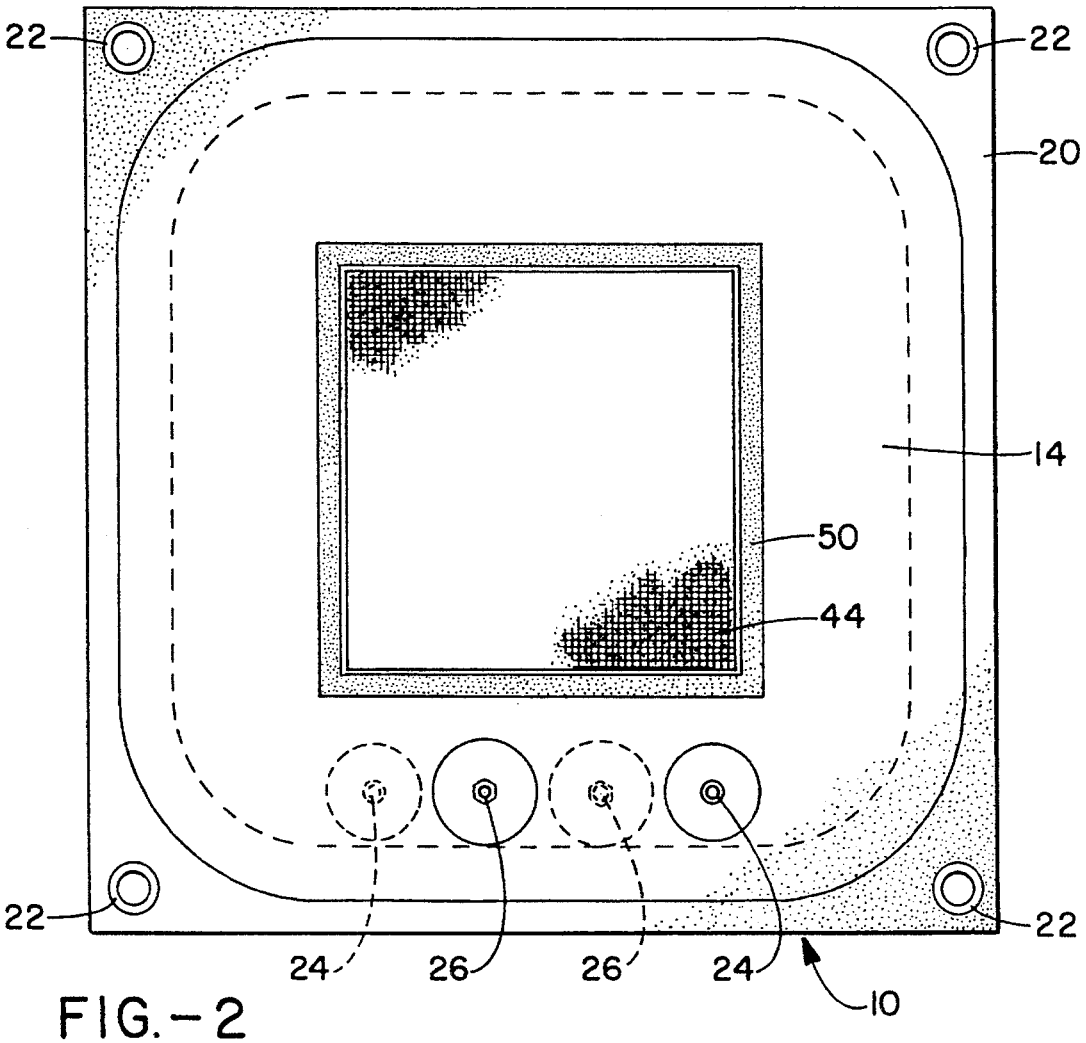
FIG. 2 is a top view of the lift bag of FIG. 1.

A third sheet 20, known hereinafter as a peripheral rim sheet, may extend outwardly from the peripheral edges of the upper and lower surface sheet 14 and 16 such that, when the chamber 12 is inflated, the peripheral rim sheet 20 extends around the chamber 12, medially thereof. This sheet is preferably made from the same or similar material as the upper and lower surface sheets 14 and 16. This peripheral rim sheet 20 may also be any configuration or shape known in the art, but is preferably substantially the same shape as the upper and lower surface sheets 14 and 16. As shown in FIG. 2, the peripheral rim sheet 20 is generally square and includes means such as metal grommet 22 at the corners thereof, to tether or otherwise secure the lift bag 10 during inflation in order to further stabilize the bag while lifting. It will be appreciated that other reinforced securing means including but not limited to D-rings, handles, straps and the like may be used in place of grommets 22. This type of securing means is seen as a significant improvement over the rubber coated fabric tethering straps of the conventional lift bags.

Furthermore, it should be noted that, in many instances, this securing means may not be necessary for each of the chambers of the lift bag 10. For instance, in some operations, it may only be necessary for each of the chambers above the bottom chamber to have the sheet 20, and therefore, not every chamber 12 must necessarily include the peripheral rim sheet 20. Moreover, it is not a requirement of the present invention that the securing means such as grommet 22 be employed in all instances, but rather the securing means is seen as aiding stability and providing safety.

Figure 3:
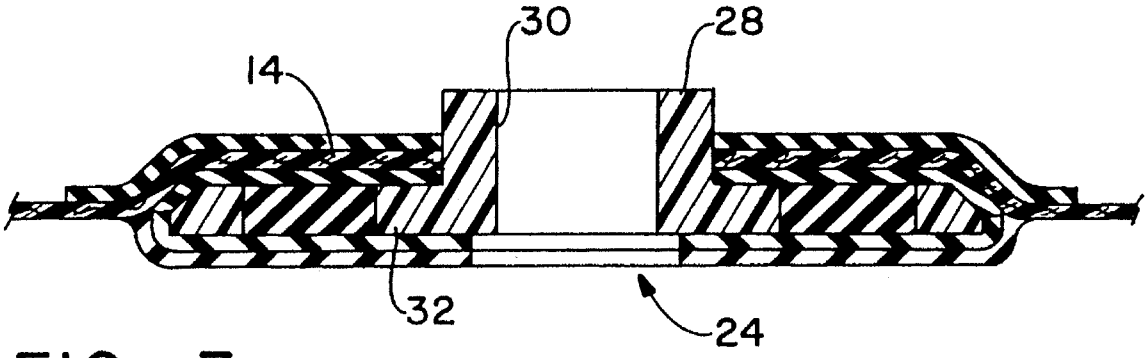
FIG. 3 is an enlarged sectional view of an inflation fitting within the lift bag of FIG. 1.
Figure 4:
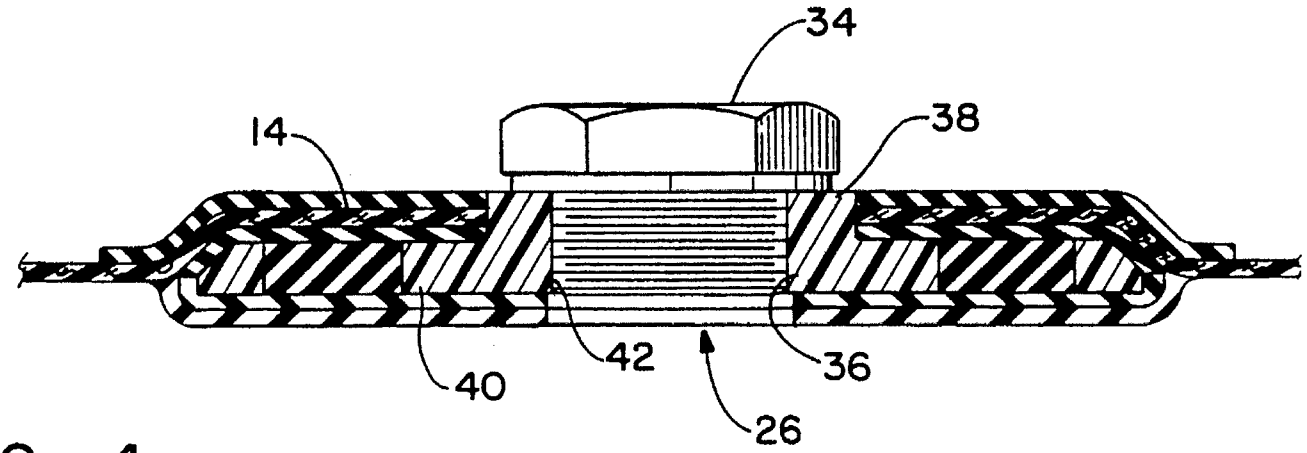
FIG. 4 is an enlarged sectional view of a relief fitting within the lift bag of FIG. 1.

As can be readily seen in FIGS. 1 and 2, each chamber 12 also includes at least one inflation fitting 24 and at least one relief fitting 26. Any conventional inflation fitting may be used in the present invention. However, it is preferred that metal inflation fittings which are capable of being sealed or vulcanized into the rubberized fabric or other material comprising the upper or lower surface sheet 14 or 16 be used. As shown in more detail in FIG. 3, each inflation fitting 24 preferably includes a centrally located mouth portion 28 defining an air receiving through bore 30 and a radially outward extending skirt portion 32 which is received and sealed within the upper surface sheet 14 of the chamber 12. Similarly, as shown in FIG. 4, each relief fitting 26 may include a valve member 34 and a fitting member 36. The fitting member 36 is similar to the inflation fitting 24, and includes a centrally located mouth portion 38 and a radially outward extending skirt portion 40. Like the skirt portion 32 of the inflation fitting 24, the skirt portion 40 is also received and sealed within the upper surface sheet portion 14 of each chamber 12. In addition, the mouth portion 38 of the fitting member 36 includes a centrally disposed bore 42 for receiving the valve member 34. Preferably, the mouth portion 38 and valve member 34 are threadably compatible. One relief fitting 26 known to be suitable for the present invention is produced and available from Halkey Roberts. Inc. of St. Petersburg, Fla., although it will be understood that any relief valve known in the art and suitable for the purposes of the invention as described herein will suffice.

The inflation and relief fittings 24 and 26 of the present invention are unique as compared to any other air inlet operation used on conventional lift bags. With the fittings of the present invention, it may even be possible to repair them. For example, the fittings can be rethreaded should the threads thereof become damaged. Moreover, the valve member 34 can easily be replaced if necessary. Also, the fittings of the present invention are not subject to being pinched or kinked like the air inlet tubes of the prior lift bags, thereby reducing the possibility of leaks.

At this point, as best shown in FIG. 1, it is noted that the inflation fitting 24 and relief fitting 26 for each chamber 12 preferably are not aligned vertically with any other inflation fittings and relief fittings for adjacent chambers, and even more desirably, for any other chamber 12. This nonalignment of the inflation and relief fittings 24 and 26 permits the lift bag 10 to lay much flatter in its deflated condition than would otherwise be possible if the inflation fittings 24 and relief fittings 26 were aligned. The exact location of the inflation fittings 24 with respect to the relief fittings 26 may vary depending upon the number of chambers 12 each lift bag 10 has, but conventionally, the inflation fittings are positioned to start at the left on one side of the lowest chamber and proceed to the right for the chambers found thereabove while the relief valves are positioned at the right on one side of the lowest chamber and proceed to the left for the chambers thereabove. It will also be understood that the inflation fittings 24 and relief fittings 26 may have been sealed within the lower surface sheet 16 instead of the upper surface sheet 14 without departing from the spirit of the invention.

Figure 5:
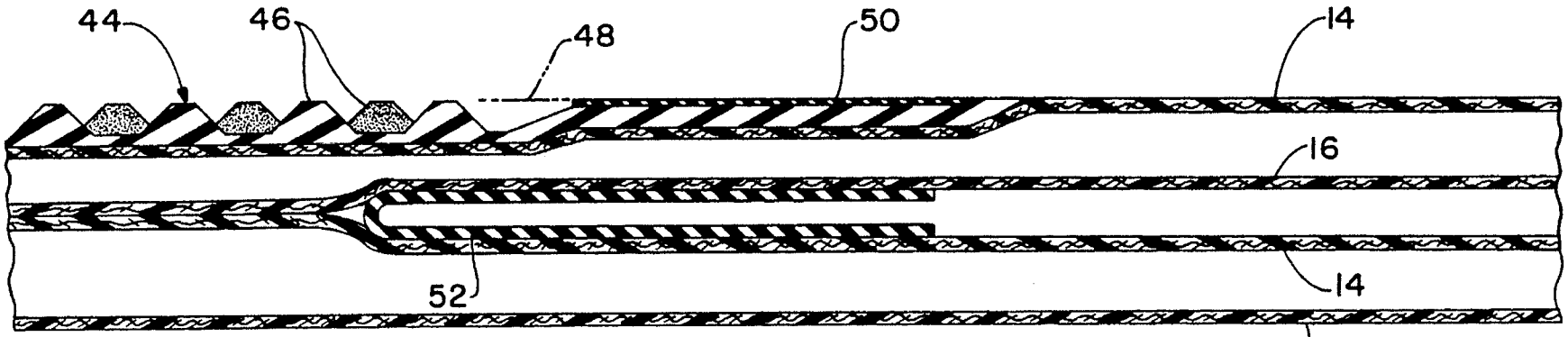
FIG. 5 is an enlarged partial sectional view of the lift bag of FIG. 1 in its initially flat or deflated condition.

On the top of the lift bag 10, a textured pad 44 made of a material compatible with the material of the upper surface sheet 14 may be provided to furnish an effective gripping surface during the lifting process. This pad 44 provides further stability to the lift bag 10 and load during the lifting process. Preferably, the pad 44 comprises a plurality of small, frusto-conical shaped nubs 46 arranged in a generally checkerboard pattern. As best seen in FIG. 5, the pad 44 is preferably recessed within the upper surface sheet 14 of the top chamber 12 of the lift bag 10 such that nubs 46 do not protrude beyond the top surface 48 of the upper surface sheet 14. This design makes the manufacturing process easier, but does not necessarily constitute a limitation of the invention. The pad 44 may also be vulcanized to the top of the upper surface sheet 14 in the same manner as the sheets themselves are vulcanized together as described hereinbelow.

As best seen in FIG. 2, a visual aid such as yellow stripe 50 may surround the nubs 46 on the gripping pad 44 and is used to aid rescuers in determining how and where the lift bag 10 should be positioned in a rescue operation. More particularly, the yellow stripe denotes to the user the contact lifting area of the lift bag. It will be appreciated that a similar pad (not shown) may be provided for the bottom of the lift bag as well for instances where a floor gripping surface may be necessary.

Furthermore, as noted hereinabove, adjacent chambers 12 are attached to each other, but no air from the chambers 12 passes between them, providing further stability. The lower surface sheet 16 of one chamber may be attached to the upper surface sheet 14 of an adjacent chamber by any means known in the art for fastening or connecting the sheets together, such as by stitching one sheet to the other. However, it is preferred that, when the rubberized fabric discussed hereinabove is employed as the sheets of material defining the chambers, the lower surface sheet of one chamber and the upper surface sheet of the adjacent chamber are vulcanized together over a particular area of the surfaces of each sheet. In addition, a tape 52 such as folded reinforcing tape or "crotch" tape may be used to connect the two adjacent sheets around the area vulcanized together.

As shown in FIG. 5, tape 52 may be folded over to form a generally C-shaped cross-section with one portion attached to the lower surface sheet of one chamber and another portion vulcanized to the upper surface sheet of the adjacent chamber. The tape is also preferably made of a compatible uncured rubberized material, and therefore, can be vulcanized to or otherwise sealingly attached to the rubberized fabric or other material comprising the upper and lower surface sheets. For example, when neoprene is utilized on the sheets, that rubber may also be used as the means of connecting the sheets together, the uncured neoprene tape being vulcanized to the rubberized sheets.

More specifically, it is preferred that the present invention not use glue to sealingly attach the sheets together. Rather, to construct the lift bag of the present invention, all of the pieces of the bag are cut soon after the rubber is impregnated into the fabric. The pieces are then laid out to "dry". During this drying period, each of the chambers are constructed and connected to each other. The bag is then placed in an autoclave and is baked under pressure for a prolonged curing time. When the bag is removed from the autoclave, it is cured or vulcanized together and all of the chamber-forming sheets and peripheral rim sheets are joined as one piece. To prevent the entire top and bottom sheets of each chamber from being vulcanized together, an isolation sheet is placed therebetween.

Accordingly, when the chambers are vulcanized together, the area on the top and bottom of each chamber 12 of the lift bag 10 where the sheets are sealed together remains substantially flat provided the air pressure in each chamber is substantially the same. Generally, only the peripheries of the upper surface sheets 14 and the lower surface sheets 16 curve downwardly or upwardly, respectively, to form the chamber 12 upon inflation. When unrestrained, the top surface of the uppermost chamber of the lift bag 10 and the bottom surface of the lowermost lift bag 10 will bulge upon inflation. However, when restrained and in use, the bottom of the lowermost chamber of the lift bag also does not bulge substantially in most cases. Similarly, the top of the uppermost chamber will not bulge when suitably restrained. Moreover, in light of the rather harsh environments to which the lift bags are subjected, sheets of additional thickness may be used for the top and bottom surface of the lift bag in some instances to provide protection of the lift bag.

It will be appreciated that those skilled in the art can readily determine the height to which each chamber may inflate. Preferably, each chamber may inflate to a height of about 0 inches to 16 inches, depending upon the size of the chamber and/or the pressure supplied to each chamber. If additional height is required, it is suggested that a lift bag with more chambers be employed. Most desirably, a 43-inch (length)×43-inch (width) lift bag can include two, and sometimes three, chambers, each of which may be inflated to an approximate height of 12 inches, so that the lift bag may inflate to a total height of about 24 inches or 36 inches depending upon the number of chambers employed. However, a 58-inch×58-inch lift bag preferably includes three chambers, each of which may be inflated to a height of about 16 inches, for a total height of about 48 inches.

In use, it should be understood that the lift bag 10 is initially fabricated and produced in a relatively flat state, similar to the conventional, single chambered lift bags. Each chamber 12 may be inflated by connecting an air hose (not shown) or the like to the inflation fitting 24 and dispensing air under pressure through the air hose and inflation fitting 24 to the chamber 12 of the lift bag 10. As the air pressure builds in the chamber 12, the upper surface sheet 14 and the lower surface sheet 16 defining the chamber expand in a manner such that the periphery of each of the sheets 14 and 16 curves gradually downward or upward, respectively, thereby forming the inflated chamber into the shape of a pillow. Not unexpectedly, the bending of the sheets causes the width and length of the chamber to shrink slightly upon inflation. Notably, however, as indicated hereinabove, the central area of the upper and lower surface sheets of each chamber remain substantially flat except for the sheets used for the top and bottom of the lift bag 10 unless otherwise restrained.

Preferably, in order to better control the lifting operation, the lowermost chamber should be inflated first. Once the lowermost chamber is inflated to a specified height, then the next lowest chamber may be inflated using the same technique described hereinabove. This sequence of inflating the lowermost chamber first provides improved stability to the lift bag. Notably, it has been found that if air is permitted to pass between the chambers of the lift bag, the top chamber(s) will fill first with air and then, at some point, the bottom chamber(s) will suddenly spring open, causing the load being lifted to bounce or jump and become unstable and dangerous to the rescuer. It will be appreciated, however, that inasmuch as no air passes between the chambers 12 of the lift bag of the present invention, this does not happen. Thus, when desired, simultaneous inflation of all the chambers 12 of the lift bag 10 may be performed.

Furthermore, each chamber of the lift bag 10 of the present invention may be filled and maintained at pressures of up to 15 psig, and preferably within a pressure range of about 10 psig to 15 psig, at heights of from about 0 inches to 16 inches. This low to medium air pressure provides greater flexibility than is allowed with standard single chambered lift bags which operate at pressures of up to only about 7 to 7.5 psig. Moreover, should the instance arise where a chamber becomes overinflated, each chamber 12 has a built-in relief valve to permit the overabundance of air to escape without bursting or rupturing the chamber which would consequently destabilize the object being lifted. The relief valve for each chamber will allow air to escape if air pressure within the chamber 12 builds to a predetermined point, typically about 14 psig. Accordingly, the burst pressure of the chamber 12 is not a concern for the present invention when correctly operating relief valves are in place and the lift bag is restrained to specified lifting heights.

In order to demonstrate practice of this invention, each chamber of an unrestrained 58-inch×58-inch lift bag was tested by inflating each chamber simultaneously with air. The correctly operating relief valve opened at 15 psig, thereby keeping the chamber from bursting. The relief valve was then effectively shut off and the chamber further inflated to determine that the burst pressure of that chamber of the bag was about 37.5 psig, approximately 2.5 times the operating pressure.

In addition, another test was also conducted using three other bags similar to the present invention, but having only one chamber. However, these bags were tested in a restrained conditional 13 inch void space. These bags included (1) a 42 inches×81 inches light-weight bag fabricated from a light-weight rubberized fabric, (2) a 42 inches× 81 inches medium-weight bag fabricated from a medium-weight rubberized fabric, and (3) a 45 inches×90 inches heavy-weight bag fabricated from a heavy-weight rubberized fabric for the sheets and yet another rubberized fabric for the crotch tape. The results were as follows.

TABLE I

| Fabric | Bag Ruptured (psig) | Failure Mode |
|---|---|---|
| 1 | 38 | Separation of pinched seam and tearing of tape in fold |
| 2 | 74.5 | Tear in fabric adjacent to tape |
| 3 | 84 | Rip along fold of tape and separation along pinched seam |

The allowance for higher pressure in the chambers of the lift bags of the present invention is based, at least in part, on the fact that the stress placed on a bag is a function of pressure and the radius of the bag. For the same tensile strengths in a single chambered bag and a multi-chambered bag, pressure in the multi-chambered bag can be much higher than in the single chambered bag when inflated to the same height due to the difference in the radii of the chambers of the bags.

The lift bag 10 may be fastened to the object being lifted or a more stable object to provide still further stability. This may be done by attaching one end of a rope or other fastening means to the grommet 22 at the corners of the peripheral rim sheet 20 and the other end of the rope to that object to be lifted or that object to help with stability.

Thus it should be evident that the lift bag of the present invention and the method for use thereof are highly effective in controlling and stabilizing heavy loads to be lifted. The invention is particularly suited for use in emergency rescue operations such as may be necessary for lifting vehicles and the like, but is not necessarily limited thereto.

Based upon the foregoing disclosure, it should now be apparent that the objects of the present invention have been satisfied by the structure presented hereinabove and that the use of the present invention described herein will carry out the objects as well. While, in accordance with the patent statutes, only the best mode and preferred embodiment of the invention has been presented and described in detail, it is to be understood that any variations evident fall within the scope of the claimed invention and thus, the selection of specific component elements can be determined without departing from the spirit of the invention herein disclosed and described. Accordingly, the scope of the invention shall include all modifications and variations that may fall within the scope of the attached claims.

What is claimed is:

1. A lift bag for lifting at least one object comprising:

a plurality of independently and selectively inflatable and deflatable chambers, each said chamber including an inflation fitting and relief fitting and being defined by an upper surface sheet and a lower surface sheet, wherein a portion of each said upper surface sheet of one chamber positioned below an adjacent chamber is securely attached to a portion of said lower surface sheet of said adjacent chamber, each said upper and lower surface sheet comprising a rubberized fabric, and an uppermost portion of said plurality of chambers including a textured pad for gripping the object to be lifted.

2. A lift bag according to claim 1 wherein each said inflation fitting and each said relief fitting of each chamber is not aligned vertically with any other respective inflation fitting or respective relief fitting on any adjacent chamber.

3. A lift bag according to claim 1, further comprising an uncured rubberized tape material communicating between said upper surface sheet and said lower surface sheet of said adjacent chamber thereabove, and connecting said upper surface sheet to said lower surface sheet around said portions of said upper and lower surface sheets vulcanized together.

4. A lift bag, according to claim 1, wherein each said upper and lower surface sheet includes an uncured rubber-impregnated fabric and wherein said upper surface sheet of one chamber positioned below an adjacent chamber is vulcanized to said lower surface sheet of said adjacent chamber.

5. A lift bag according to claim 1, wherein said textured pad includes a plurality of frusto-conical shaped nubs arranged in a checkboard pattern.

6. A lift bag according to claim 1, further comprising visual aid means around said textured pad to aid in positioning of the lift bag and in determining a contact area of the lift bag.

7. A lift bag according to claim 1, further comprising a peripheral rim sheet disposed medially around at least one of said chambers.

8. A lift bag according to claim 7, wherein said peripheral rim sheet includes securing means to tether the lift bag.

9. A lift bag according to claim 1, wherein each said chamber can be inflated to a height of at least 16 inches.

* * * * *